US010597221B2

(12) United States Patent
Snyder et al.

(10) Patent No.: US 10,597,221 B2
(45) Date of Patent: Mar. 24, 2020

(54) HIGH PRESSURE REDUCING TILT NOZZLE

(71) Applicant: Worthington Industries, Inc., Columbus, OH (US)

(72) Inventors: Micah Matthew Snyder, Westerville, OH (US); Jody Alan McKinley, Mount Vernon, OH (US)

(73) Assignee: WORTHINGTON INDUSTRIES, INC., Columbus, OH (US)

( * ) Notice: Subject to any disclaimer, the term of this patent is extended or adjusted under 35 U.S.C. 154(b) by 0 days.

(21) Appl. No.: 16/148,369

(22) Filed: Oct. 1, 2018

(65) Prior Publication Data

US 2019/0100374 A1 Apr. 4, 2019

Related U.S. Application Data

(60) Provisional application No. 62/566,643, filed on Oct. 2, 2017.

(51) Int. Cl.
*B65D 83/46* (2006.01)
*F17C 7/00* (2006.01)

(52) U.S. Cl.
CPC ..... *B65D 83/46* (2013.01); *F17C 7/00* (2013.01); *F17C 2205/0338* (2013.01); *F17C 2221/017* (2013.01)

(58) Field of Classification Search
CPC .... B65D 83/46; F17C 7/00; F17C 2205/0338; F17C 2221/017
USPC ..... 222/402.21
See application file for complete search history.

(56) References Cited

U.S. PATENT DOCUMENTS 8,132,564 B2 * 3/2012 Stone ..... F17C 13/04 124/74
2009/0078321 A1 * 3/2009 Arnott ..... F17C 13/00 137/14
2018/0037307 A1 * 2/2018 Brewer ..... B63C 11/2209

* cited by examiner

*Primary Examiner* — Donnell A Long
(74) *Attorney, Agent, or Firm* — Tucker Ellis LLP; Patrick Clunk

(57) ABSTRACT

Provided is a pressure reducing tilt nozzle that includes a body defining a cavity having an inlet and an outlet, and a piston disposed in the cavity. The piston is biased in a first piston position away from the inlet allowing flow through the inlet and is movable toward the inlet to a second piston position preventing flow through the inlet when pressure in the cavity overcomes a biasing force biasing the piston in the first piston position.

20 Claims, 10 Drawing Sheets

HIGH PRESSURE REDUCING TILT NOZZLE

RELATED APPLICATIONS

This application claims the benefit of U.S. Provisional Application No. 62/566,643 filed Oct. 2, 2017, which is hereby incorporated herein by reference.

TECHNICAL FIELD

This application relates generally to devices used to fill balloons, and more particularly, to a high pressure reducing tilt nozzle.

BACKGROUND OF THE INVENTION

A pressure tank containing a pressurized gas, a shutoff valve, and a tilt valve can be used for filling balloons. The tank is used to store a gas under a pressure, and the tank, the shutoff valve, and the tilt valve are placed in fluid communication with one another. The gas passes from the tank, through the shut off valve, through the tilt valve, and into the balloon in an effort to establish pressure equilibrium.

The pressure tank and the shutoff valve can be of unitary construction. The shutoff valve generally provides a measure of safety that ensures that the pressurized gas inside the tank does not leak out unwantedly or is not dispensed inadvertently or accidentally. For example, the shut off valve is typically closed to prevent the loss of gas when the device is being stored or transported or when the device is not being used to fill balloons.

The tilt valve is placed in fluid communication with the shutoff valve by threading the tilt valve onto a mating threaded outlet port of the shutoff valve, the shutoff valve and the tilt valve having corresponding male and female threads, respectively. To fill a balloon, a consumer opens the shutoff valve, slides the neck of the balloon over the end of the tilt valve and presses against the side of the tilt valve, opening the tilt valve, transferring a portion of the pressurized gas stored in the pressure tank into the balloon to expand the balloon.

The pressure tank is generally filled with pressurized helium. From time to time, due to global helium supply issues, these tanks can contain a mixture of helium and air. To store a reasonable amount of gas in a practically sized tank, the gas within the tank is conventionally pressurized to approximately 240 to 260 pounds per square inch (psi) or approximately 16.9 to 18.3 kilograms per square centimeter ($kg/cm^2$) although higher pressures are sometimes used. For example, one standard tank that is reasonably light weight and portable contains 8.9 cubic feet (ft3) or approximately 0.25 cubic meters (m3) of helium/air mixture and is capable of filling up to thirty (30) 9 inch (22.86 centimeters) balloons. A somewhat larger or jumbo tank contains 14.9 cubic feet or approximately 0.42 cubic meters (m3) of helium/air mixture is capable of filling up to fifty (50) 9 inch (22.86 centimeters) balloons for example.

SUMMARY OF THE INVENTION

In accordance with an embodiment of the present invention, a pressure reducing tilt nozzle is provided that includes a body defining a cavity having an inlet and an outlet, a piston disposed in the cavity and biased in a first piston position away from the inlet allowing flow through the inlet, the piston being movable toward the inlet to a second piston position preventing flow through the inlet when pressure in the cavity overcomes a biasing force biasing the piston in the first piston position, a spindle having a first end disposed in the cavity and a second end, the spindle being biased in a first spindle position toward the outlet preventing flow through the outlet, and a sleeve coupled to the body and surrounding the second end of the spindle, wherein the sleeve is configured to be moved by a user to move the spindle from the first spindle position to a second spindle position allowing flow through the outlet thereby reducing the pressure in the cavity such that the piston moves to the first piston position.

In accordance with another embodiment, a pressure reducing tilt nozzle is provided that comprises a piston pressure regulator including a body having a first portion and a second portion defining a cylinder, the first portion having an inlet configured to be in fluid communication with a source of pressurized gas and the second portion having an outlet, a piston slideable within the cylinder and including a first end, a second end, and a fluid passageway, the first end forming with the body a first pressure chamber and the second end forming with the body a second pressure chamber, the first and second pressure chambers being in fluid communication through the axial fluid passageway, and a first spring disposed between the piston and the first portion of the body, and a spindle including a spindle rod having a proximal end and a distal end, the distal end of the spindle rod extending through the outlet and being tiltingly responsive to a lateral force on the spindle rod applied by a use, and a disk coupled to the proximal end of the spindle rod, the disk including a first side forming a spring seat and a second side configured to seal to the outlet, the disk being biased toward the outlet to seal to the outlet, wherein when a force is applied to the distal end of the spindle rod to tilt the spindle rod and the disk out of sealing contact with the outlet, a gas is dispensed through the outlet from the source of pressurized gas.

In accordance with still another embodiment, a pressure reducing tilt nozzle is provided that comprises a body defining a cavity having an inlet and an outlet, a piston movable within the cavity and configured to divide the cavity into at least a first pressure chamber and a second pressure chamber, the piston including a fluid passageway that fluidly connects the first pressure chamber and the second pressure chamber, a first spring disposed in the cavity between the body and the piston to bias the piston away from the inlet, a nozzle assembly movable between a first position sealing the nozzle assembly against the outlet and a second position unsealing the nozzle assembly from the outlet, and a second spring disposed in the cavity between the piston and the nozzle assembly to bias the nozzle assembly in the first position, wherein a biasing force of the first spring is greater than a biasing force of the second spring.

These and other objects of this invention will be evident when viewed in light of the drawings, detailed description and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
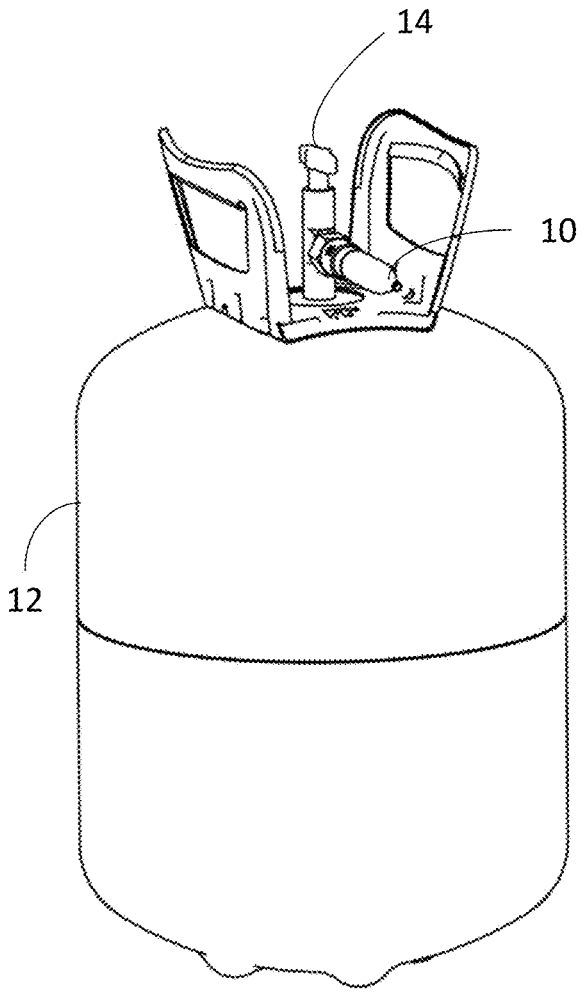
FIG. 1 is a perspective view of a high pressure reducing tilt nozzle in combination with a pressure tank according to one embodiment.

Embodiments of the invention relate to methods and systems that relate to a high pressure reducing tilt nozzle comprising a piston pressure regulator and a tilt valve for use in combination with pressure tanks that are pressurized with a gas to greater than, for example, about 240 to 260 psi (16.9 to 18.3 kg/cm$^2$), i.e., a high pressure, and that provides a good user experience, allowing the user to dispense the gas from the pressure tank and into a balloon at a lower pressure and at a reasonable rate, with good control and without a balloon filling too quickly or too slowly. The regulator provides for dispensing a gas at a pressure below the gas cylinder pressure. Further, the present application allows for the use of a comparably smaller pressure tank for enhanced portability or a larger balloon filling capacity, i.e., quantity and size, for a given pressure tank size.

With reference to the drawings, like reference numerals designate identical or corresponding parts throughout the several views. However, the inclusion of like elements in different views does not mean a given embodiment necessarily includes such elements or that all embodiments of the invention include such elements. The examples and figures are illustrative only and not meant to limit the invention, which is measured by the scope and spirit of the claims.

Turning now to FIG. 1, a high pressure reducing tilt nozzle 10 is shown in combination with a pressure tank 12. The pressure tank 12 may be made of any suitable material, such as mild steel, and may be suitably sized, such as being about 17 inches (43 centimeters) tall and 9.75 inches (25 centimeters) in diameter. For example, in another embodiment, pressure tank 12 is about 18 inches (46 centimeters) tall and 12 inches (31 centimeters) in diameter. It will be appreciated that the size and/or the shape of the pressure tank 12 can be varied, as desired, to change the balloon filling capacity, i.e., quantity and/or size. The pressure tank 12 generally contains pressurized helium for use in filling balloons, but may contain a mixture of helium and air, such as a mixture of helium and air with not less than eighty percent helium. The helium/air mixture may have a suitable pressure, such as greater than about 150 psi (10.5 kg/cm$^2$).

The pressure tank 12 can include a shut off valve 14 that provides a measure of safety that ensures that the pressurized helium/air mixture inside the pressure tank 12 does not leak out unwantedly or is not dispensed inadvertently or accidentally. In use, the shut off valve 14 is typically closed to prevent the loss of gas when the pressure tank 12 is being stored or transported or when the pressure tank 12 is not being used to fill balloons. The shut off valve 14 is typically completely opened when filling balloons.

Figure 2:
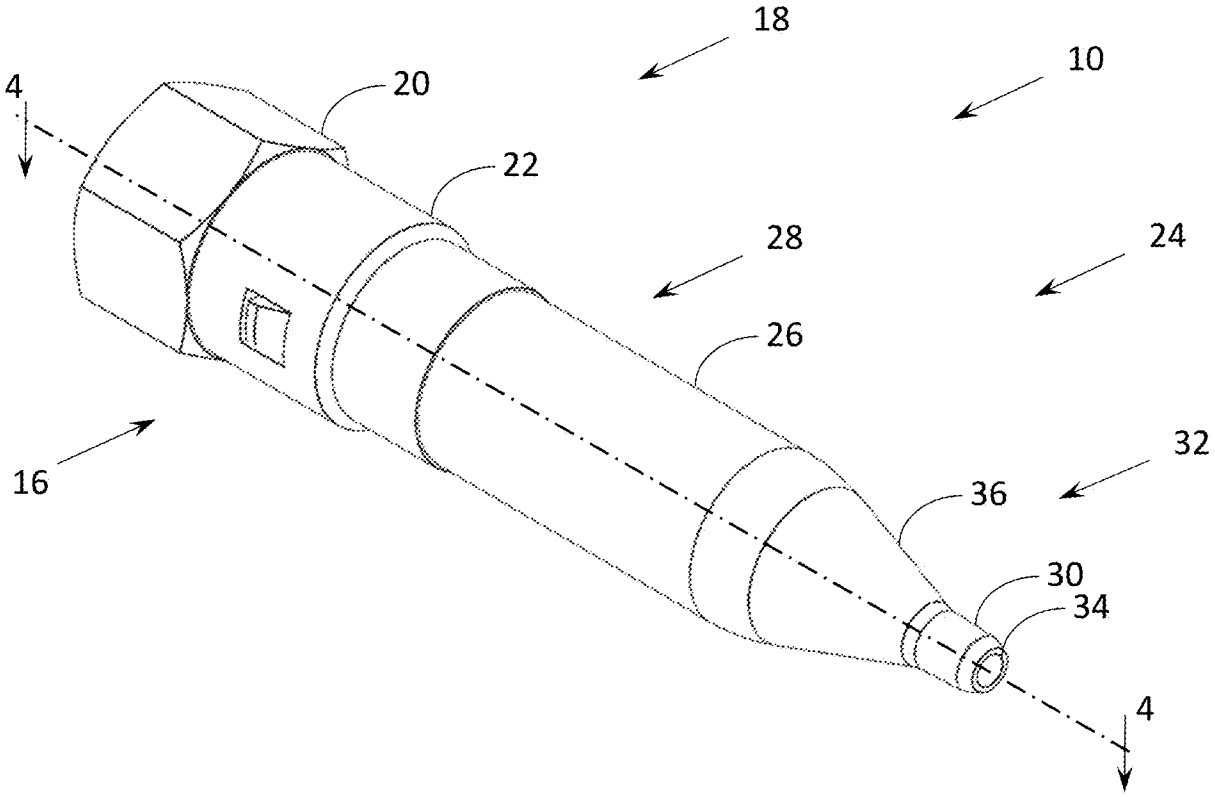
FIG. 2 is a perspective view of the high pressure reducing tilt nozzle.

Referring now to FIG. 2, the high pressure reducing tilt nozzle 10 generally includes a body 18 having a first portion 20 and a second portion 22 defining a piston pressure regulator 16. The high pressure reducing tilt nozzle 10 can further include a rubber sleeve 24 having a first cylindrical portion 26 at a proximal end 28 for sealably engaging and/or coupling to the second portion 22 of the body 18, and a second cylindrical portion 30 having an aperture 34 at a distal end 32. A tapered portion 36, proximate the distal end 32, forms a transition between the first and the second cylindrical portions 26, 30, respectively, and configures the distal end 32 of the rubber sleeve 24 to slidably receive the neck of a balloon.

In one embodiment, the first and the second portions 20 and 22 of the body 18 can be an injection molded synthetic polymer, such as nylon. In another embodiment, the first and the second portions 20 and 22 of the body 18 can be machined from a metal, such as brass or steel, for example. In the illustrated embodiment, the regulator is made from two separate parts, joined and fixed together. In yet another embodiment, the body 18 can be of unitary construction, the body 18 defining a cavity. It will be appreciated that a suitable material and method of construction of the body 18 may be used.

In the embodiment shown, the sleeve 24 is made from a rubber product, and is resilient in nature, returning to its original shape after having received a force from a user as will be described hereinafter. In other embodiments, the rubber sleeve 24 can also be made from a variety of resilient materials, natural or synthetic, using a variety of methods.

Figure 3:
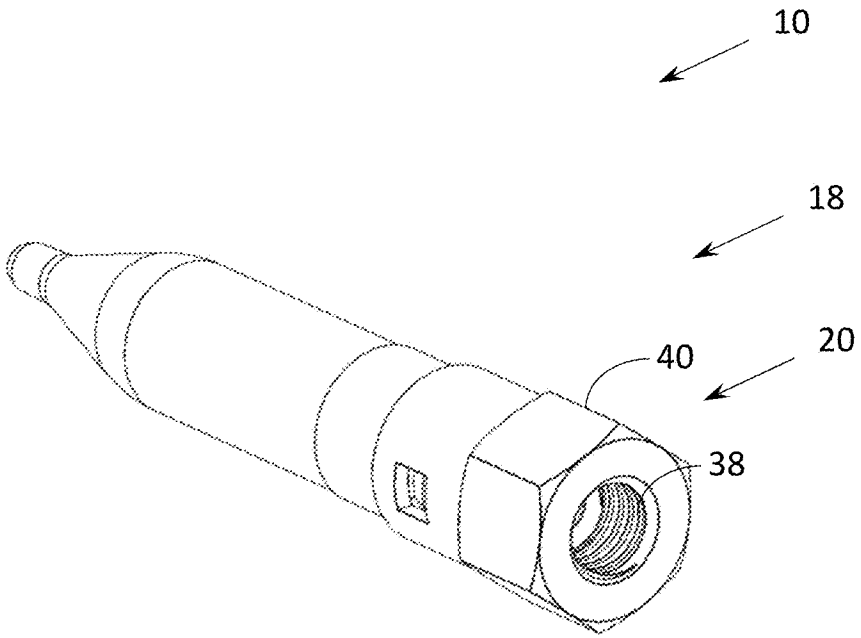
FIG. 3 is another perspective view of the high pressure reducing tilt nozzle.

Referring now to FIG. 3, the first portion 20 of the body 18 of the high pressure reducing tilt nozzle 10 is configured to be placed in fluid communication with or receive a source of pressurized gas, e.g., helium or a helium/air mixture. Specifically, the first portion 20 of the body 18 includes a threaded counter bored hole 38. As shown and for example, the threaded counter bored hole 38 is threaded to a standard specification threading of 7/16"-20UNF-2B-RH-INT, there being no direct metric equivalent, and corresponds to a male fitting on the shut off valve 14 of the pressure tank 12, shown in FIG. 1. Further, a 19 millimeter (mm) wrench can be used on nut portion 40, tightening or torqueing to approximately 7 to 11 kilogram-force•centimeter (kgf-cm) to provide a gas tight seal with the shut off valve 14, shown in FIG. 1. It will be appreciated that the size and/or type of threading and the associated nut is exemplary of one particular embodiment and does not serve to limit the application. It will also be appreciated that other threads having different sizes and using different standards can be used, as desired, without departing from the present application. Moreover, in other embodiments, the high pressure reducing title nozzle 10 can be directly connected to the pressure tank 12.

Figure 4:
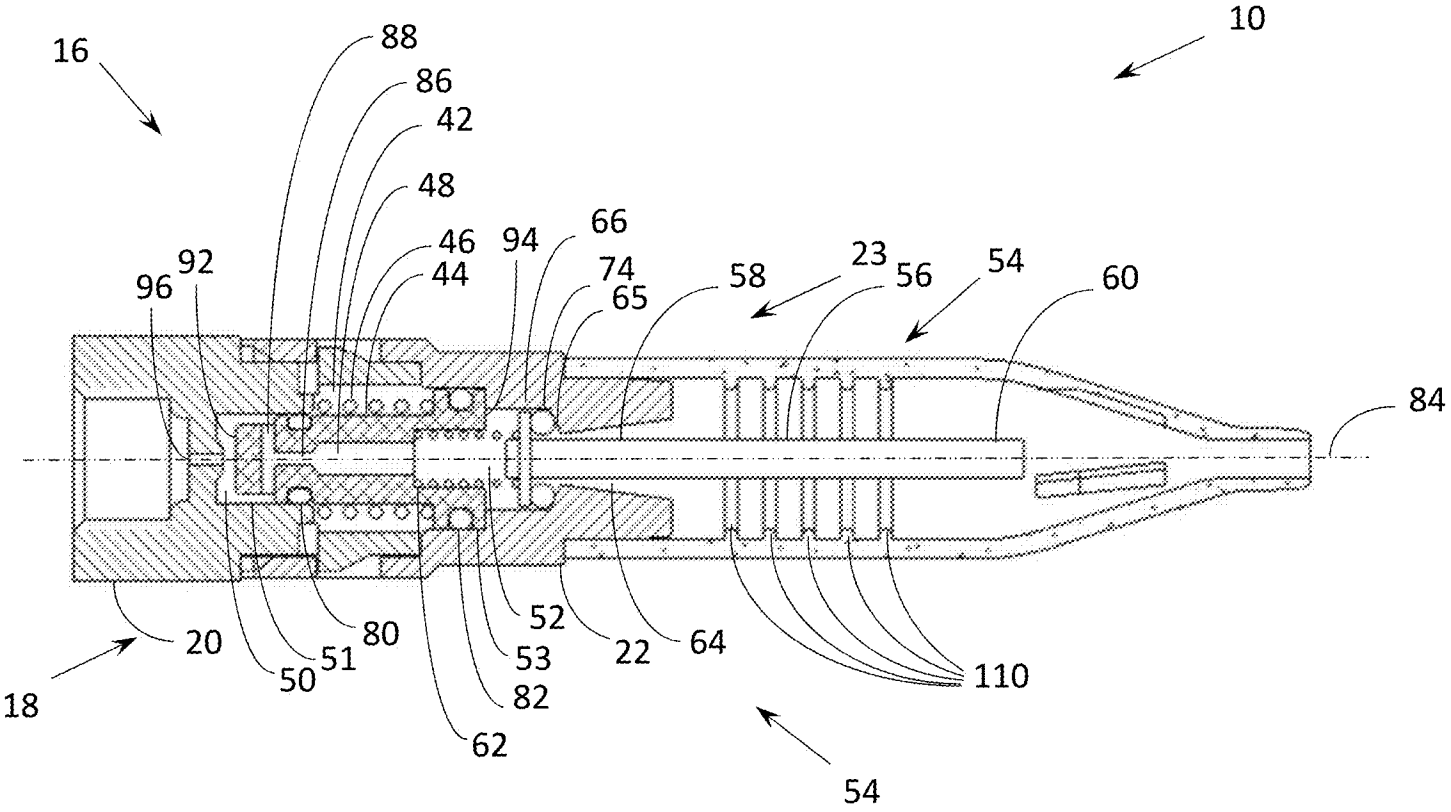
FIG. 4 is a cross-sectional view taken along line 4-4 in FIG. 2.

Referring to FIG. 4, a cross-sectional view taken along line 4-4 in FIG. 2 is shown. As shown, the high pressure reducing tilt nozzle 10 includes a piston pressure regulator 16. The piston pressure regulator 16 includes a body 18, a piston 44, and a first spring 46. The body includes a first portion and a second portion 20 and 22, respectively, defining a cavity 42. It will be appreciated that the body 18 could be of unitary construction. The first portion 20 is configured to be placed in fluid communication with a source of pressurized gas, e.g., pressure tank 12 shown in FIG. 1, through an orifice or an inlet 96.

The piston 44 includes a first end 92 defining a first surface area and a second end 94 defining a second surface area, and an axial fluid passageway 48, and is slideable within the cavity 42, the first end 92 being moveable sealably within a first cylinder 51 of the cavity 42 to form a first pressure chamber 50 in the first portion of the body 20, and a second end 94 being moveable sealably within a second cylinder 53 of the cavity 42, to form a second pressure chamber 52 in the second portion of the body 22. The first pressure chamber 50 is in constant fluid communication with the second pressure chamber 52 through the axial fluid passageway of the piston 44.

The first spring 46 is disposed between the piston 44 and the first portion of the body 18. As shown, an end face of the first portion 20 defines a spring seat for one end of the first spring 46 and the piston 44 has a shoulder defining a spring seat for the other end of the first spring 46. The first spring 46 is configured to bias the first end 92 of the piston 44 away from the inlet 96, to allow for the free flow of gas from the first pressure chamber 50 through the axial fluid passageway 48 to the second pressure chamber 52. Additionally, and in the embodiment shown in FIG. 4, the first spring 46 can also bias the second end 94 of the piston 44 against the second portion 22 of the body 18, preventing the piston 44 from moving when no gas pressure has been applied to the high pressure reducing tilt nozzle 10. In this embodiment, the piston 44 is an injection molded synthetic polymer, e.g., nylon. In another embodiment, the piston 44 can also be machined from a metal, such as brass or steel, for example. It will be appreciated that any suitable material and the method of construction of the piston 44 may be used.

The second portion 22 of the body 18 includes a distal end 23 having an outlet or axial aperture 64 in fluid communication with the second pressure chamber 52. The axial aperture 64 is defined by an outlet or aperture rim 65 in the second portion 22 of the body 18 and is configured to receive a spindle 54.

Figure 5:
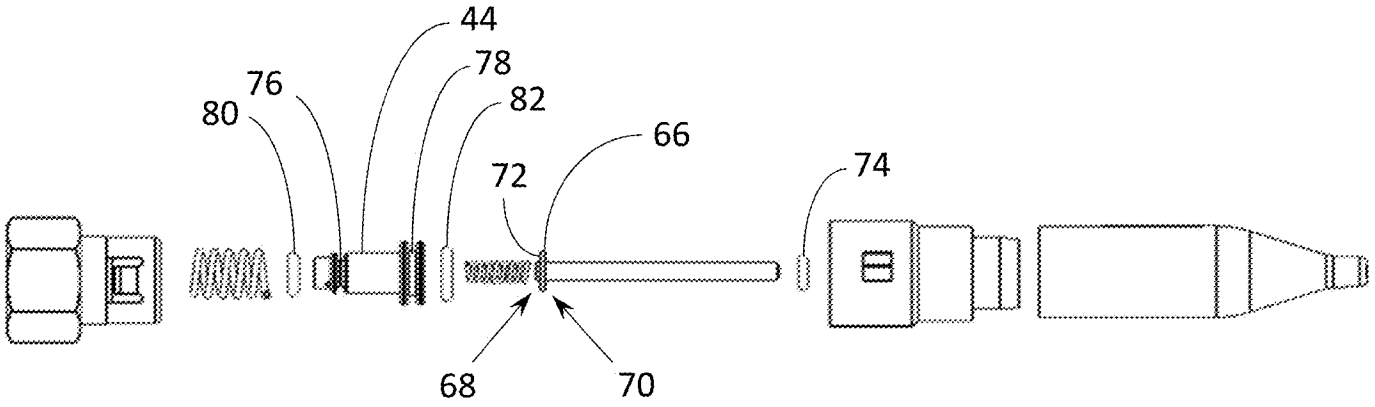
FIG. 5 is an exploded view of the high pressure reducing tilt nozzle of FIG. 2.

To this end, the high pressure reducing title nozzle 10 further comprises the spindle 54 and a second spring 62. The spindle 54 includes a spindle rod 56 and a disk 66. The spindle rod 56 has a proximal end 58 and a distal end 60. Referring also to FIG. 5, the disk 66 is coupled to the proximal end 58 of the spindle rod 56 and includes a first side 68 defining a spring seat 72 and a second side 70 facing the axial aperture 64 in the second portion 22 of the body 18. The distal end 60 of the spindle rod 56 extends through the axial aperture 64 in the second portion 22 of the body 18 and can tilt in response to a lateral force applied by a user on the spindle rod 56. The second spring 62 is disposed between the second end of the piston 94 and the spring seat 72 formed on the first side 68 of the disk 66. The second spring 62 is configured to bias the second side 70 of the disk 66 against the aperture rim 65 in the second portion 22 of the body 18 to seal the aperture 64.

Referring also to FIG. 2, to fill a balloon, a user slides the neck of a balloon over the distal end 32 of rubber sleeve 24 to sealingly engage the balloon neck with the rubber sleeve 24, and applies a force to the distal ends 32, 60, respectively, of the rubber sleeve 24 and the spindle rod 56, to tilt the spindle 54 and the disk 66 out of sealing contact with the aperture rim 64, which allows gas to dispense through the axial aperture 64 from the source of pressurized gas, e.g., pressure tank 12 shown in FIG. 1, coupled to the first portion 20 of the body 18 of the piston pressure regulator 16. A seal 74 can be included to further improve the seal between the second side 70 of the disk 66 and the aperture rim 65 in the second portion 22 of the body.

As shown in FIG. 4, the axial aperture 64 is flared, at approximately six degrees, spreading outward, from the second pressure chamber 52. In operation, this flaring allows a user to apply a force to the distal end 60 of the spindle rod 56, i.e., a force component perpendicular to a longitudinal axis 84 of the spindle 56, causing the spindle 54 and the disk 66 to articulate or tilt, from a first position shown in FIGS. 4 and 6, to a second position shown in FIGS. 7 and 8, dispensing gas from the source of pressurized gas, e.g., the pressure tank 12 shown in FIG. 1, coupled to the first portion 20 of the body 18 of the piston pressure regulator 16. It will be appreciated that other flare angles can be used and that the flare angle in the second portion 22 of the body 18 may function to limit the angular travel of the distal end 60 of the spindle rod 56 when a force is applied by a user.

In the embodiment shown, the spindle rod 56 and disk 66 are made from a metal, the disk 66 being cold-headed or welded into the spindle 56. It will be appreciated that any suitable material may be used for the spindle 56 and the disk 66 and that a suitable method of coupling the disk 66 to the spindle 56 may be used. In an embodiment the spindle 54 can be of unitary construction.

To enhance the seal, the high pressure reducing tilt valve further comprises the seal illustrated as an O-ring 74. The O-ring 74 is configured to slide over the distal end 60 of the spindle rod 56, resting against the second side 70 of the disk 66 facing the axial aperture 64 and the second portion 22 of the body 18 of the piston pressure regulator 16, as shown in FIG. 4. Again, and as shown in FIG. 4, without any force applied by a user, the second spring 62 biases the distal end 60 of the spindle rod 56 along the longitudinal axis 84 in a first position. In an alternative embodiment, the second side 70 can be made of a resilient seal material.

The bias force provided by the first spring 46 is greater than the bias force provided by the second spring 62. This ensures that the first end 92 of the piston 44 is biased away from the first portion 20 of the body 18 while the second spring 62 biases the spindle 56 along the longitudinal axis 84 as shown in FIG. 4.

Referring to FIGS. 4 and 5, the piston 44 has a first annular groove 76 formed into an outer peripheral surface of the first end 92, and a second annular groove 78 formed into an outer peripheral surface of the second end 94. The first and the second annular grooves 76 and 78 are configured to receive respective O-rings 80 and 82 to seal the first pressure chamber 50 and the second pressure chamber 52, respectively. In operation, the first and the second O-rings 80 and 82 provide gas-tight seals, respectively, between the first and the second pressure chambers 50 and 52 and the environment. It will be appreciated that the selection of the type of material used for the O-rings 74, 80, and 82 depends, in large part, on the type and pressure of the gas that the high pressure reducing tilt nozzle is used with and that the selection of the material used for the O-rings 74, 80, and 82 is made accordingly.

Referring to FIG. 4, the piston 44 also has a common longitudinal axis 84. The axial fluid passageway 48 of the piston 44 comprises an axial bore 86 along a portion of the longitudinal axis 84 and a cross bore 88 perpendicular to the longitudinal axis 84. As shown, the axial bore 86 and the cross bore 88 are in fluid communication with each other.

The piston 44 includes a first end 92 defining a first surface area in the first pressure chamber 50, and a second end 94 defining a second surface area in the second pressure chamber 52. As shown, in order for the piston pressure regulator 16 to regulate, the first surface area of the first end 92 of the piston 44 is exposed to pressure in the first pressure chamber 50 that is less than the pressure the second surface area of the second end 94 of the piston 44 is exposed to in the second pressure chamber 52. When the tilt valve is sealed over the aperture, and the cylinder contains gas at high pressure, at a steady state, the net force of gas pressure exerted on the second surface area on the second end 94 of the piston 44 in the second pressure chamber 52 exceeds the bias force on the piston 44 provided by the first and the second springs 46, 62, and the piston 44 is moved to the left in FIG. 4 to the position shown in FIG. 6, thereby causing the first end 92 of the piston 44 to seal off the inlet 96 in first portion 20 of the body 18 of the piston pressure regulator 16.

Figure 7:
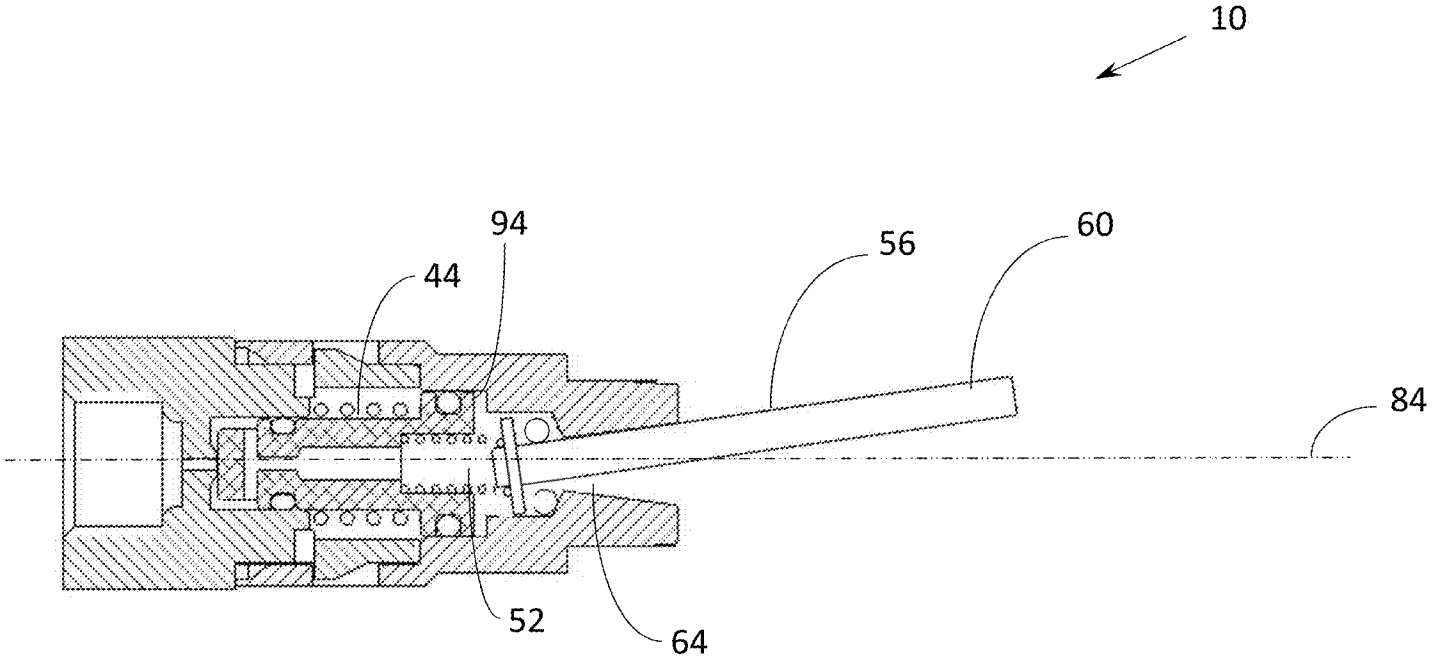
FIG. 7 is also a cross-sectional view taken along line 4-4 in FIG. 2 with a rubber sleeve removed and a spindle in a tilted position.

When a user actuates the high pressure reducing tilt valve 10, by biasing the distal end 60 of the spindle rod 56, the spindle 54 articulates or tilts, as shown in FIG. 7, and the gas trapped in the second pressure chamber 52 is released through axial aperture 64, thereby reducing the pressure in the second pressure chamber 52, and the associated force against the second surface area of the second end 94 of the piston 44. The piston 44 immediately moves back to its original position as shown in FIG. 8, allowing for the flow of pressurized gas from the source of pressurized gas coupled to first portion 20 of the body 18.

Figure 6:
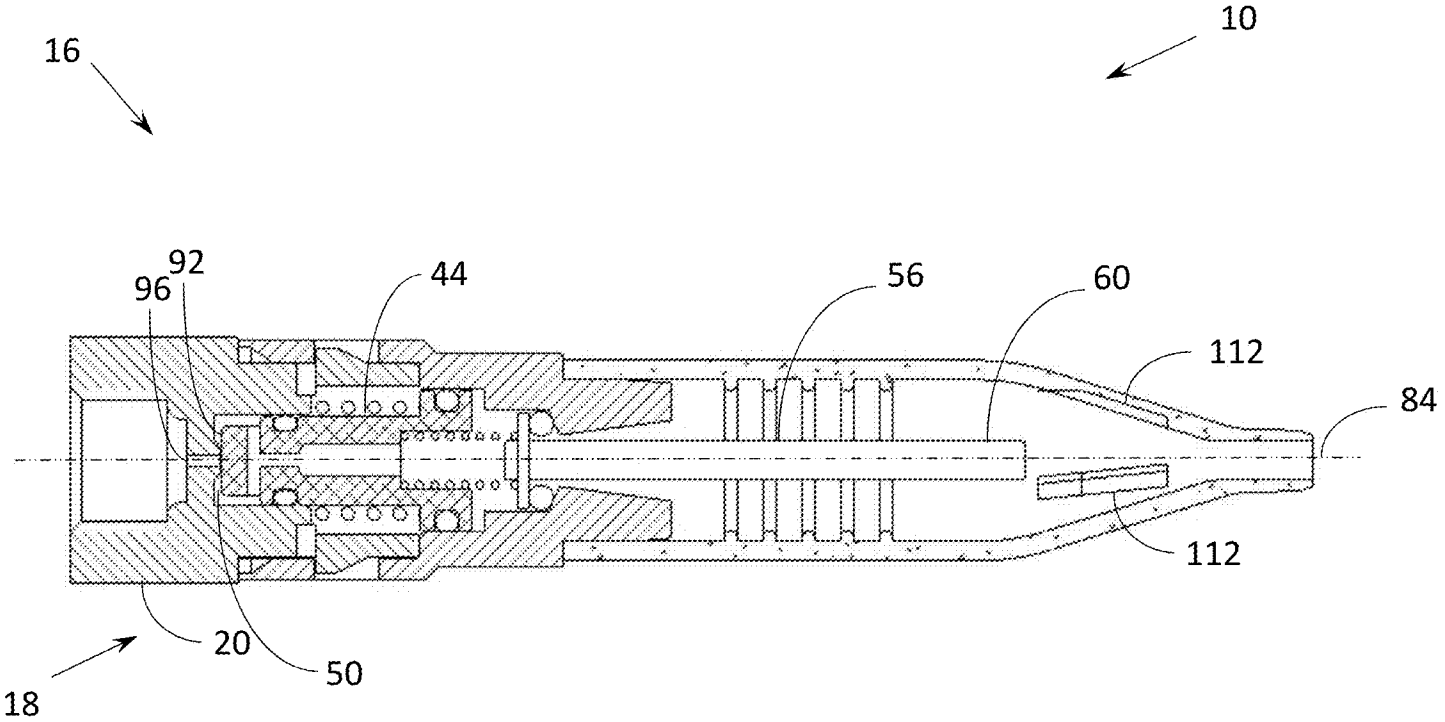
FIG. 6 is also a cross-sectional view taken along line 4-4 in FIG. 2 with a piston sealing off an orifice.
Figure 8:
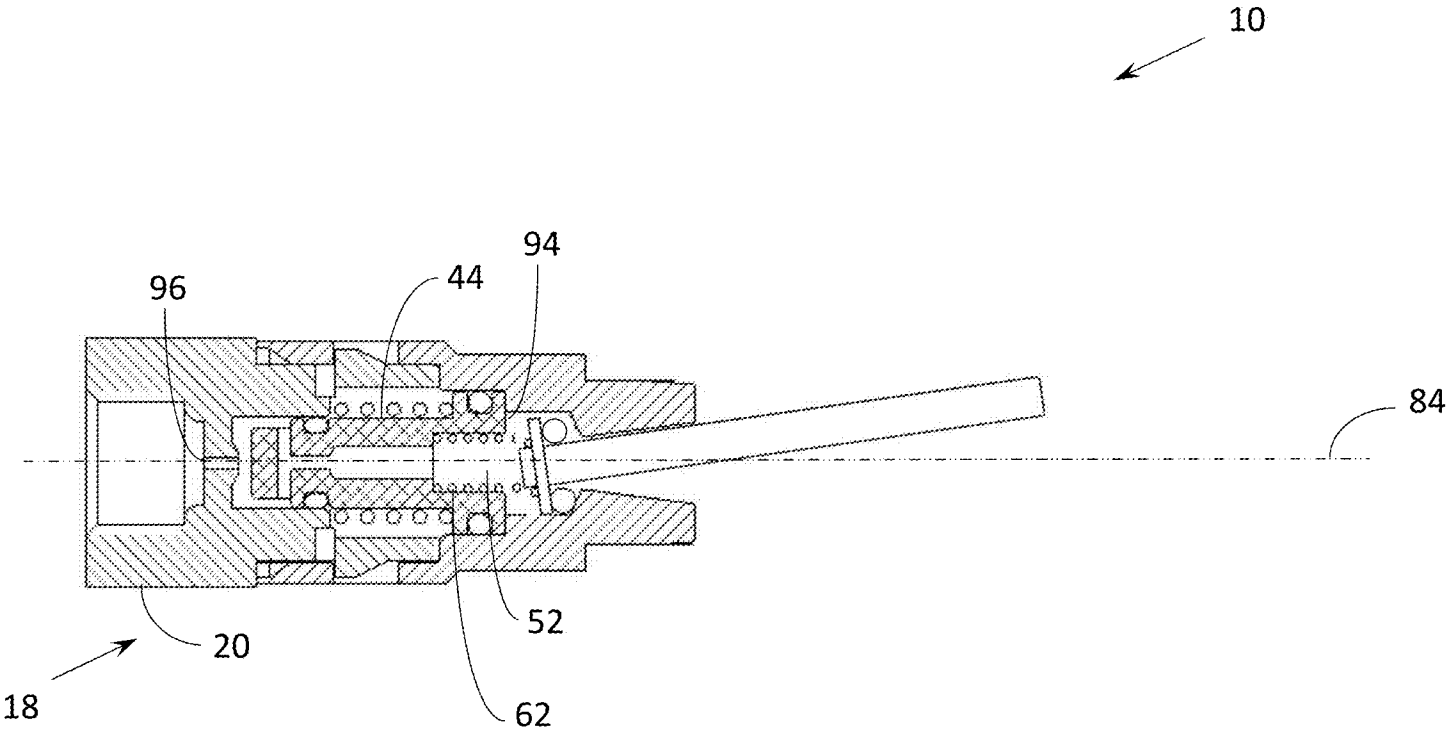
FIG. 8 is also a cross-sectional view taken along line 4-4 in FIG. 2 with a rubber sleeve removed and a spindle in a tilted position without a piston sealing off an orifice.

The piston 44 slides between the position shown in FIGS. 4 and 8 and the position shown in FIGS. 6 and 7, in response to user input and to limit or regulate the output pressure of the high pressure reducing tilt valve 10 experienced by the user. The limit on the output pressure is selected by a combination of the first and the second springs 46, 62, respectively, as will now be described in more detail.

It will be appreciated that all springs can be defined by a spring rate, the spring rate being the force required to compress or extend a spring a prescribed distance, typically given in pounds per inch or kilograms per centimeter, for example. Further, those skilled in the art will also appreciate that the embodiments described thus far describe a spring that works in compression, however, other embodiments could be configured using a spring that works in extension.

Again, the output pressure of the regulator is selectable, meaning the upper pressure limit on the output regulated pressure can be raised or lowered as desired, based on the spring rates associated with the first spring 46 and the second spring 62. For example, for a given second spring 62, to increase the output pressure limit, the spring rate of the first spring 46 would be increased and to decrease the output pressure limit, the spring rate of the first spring 46 would decreased. Conversely, for a given first spring 46, to increase the output pressure limit, the spring rate of the second spring 62 would be decreased and to decrease the output pressure limit, the spring rate of the second spring 62 would be increased.

For example and in one embodiment, where the helium/air mixture in pressure tank 12 is pressurized to 460 psi (32.3 kg/cm$^2$) and the desired output pressure is about 150 psi (10.5 kg/cm$^2$), the spring rate of the first spring 46 can be selected to provide an output regulated pressure somewhat greater than 150 psi (10.5 kg/cm$^2$) and the spring rate of the second spring 62 can be selected to reduce the output regulated pressure provided by the first spring 46 back down to the desired output pressure limit, i.e., 150 psi (10.5 kg/cm$^2$) in this example, in effect, reducing and fine tuning the "effective" spring rate of the two springs in combination. Further, the spring rate of the second spring 62 relates to the force that must be overcome by a user to tilt the distal end 60 of the spindle rod 56 so that the spindle 54 and the disk 66 are no longer in sealing contact with the aperture rim 64.

Therefore, the selection of the first and the second springs 46 and 62, respectively, simultaneously provides or allows for two things. First, a selection of the upper limit for gas pressure experienced by a user and, second, a tailoring of the feel of the force necessary to actuate the high pressure reducing tilt nozzle 10 when dispensing a gas or filling balloons.

Moreover, it will be appreciated that the high pressure reducing tilt nozzle 10 allows for substantially all of the gas in an associated pressure tank, e.g., pressure tank 12 shown in FIG. 1, to be dispensed by a user. For instance, as gas is dispensed or balloons are filled, the pressure in the pressure tank 12 drops with every successive dispense or fill. At some point, the pressure in the pressure tank 12 reaches the output regulated pressure selected by the first and the second springs 46, 62, respectively. The high pressure reducing valve 10 will nevertheless still continue to dispense gas for filling balloons because, as illustrated in FIG. 8, the pressure force exerted on the second surface associated with the second end 94 of the piston 44 will not exceed the bias exerted on the piston 44 by the first and the second springs 46 and 62, respectively, and the piston 44 will not slide to the left sealing off the inlet 96. The regulator will remain open until the last of the pressurized gas is dispensed.

Based on the teachings found herein, those of ordinary skill in the art will be able to select the first and the second springs 46, 62, respectively, as necessary, to limit the output pressure experienced by a user from the high pressure reducing tilt valve 10 and select or tailor the feel of the high pressure reducing tilt valve 10 while being able to dispense substantially all of the gas from an associated pressure tank 12.

Figure 9:
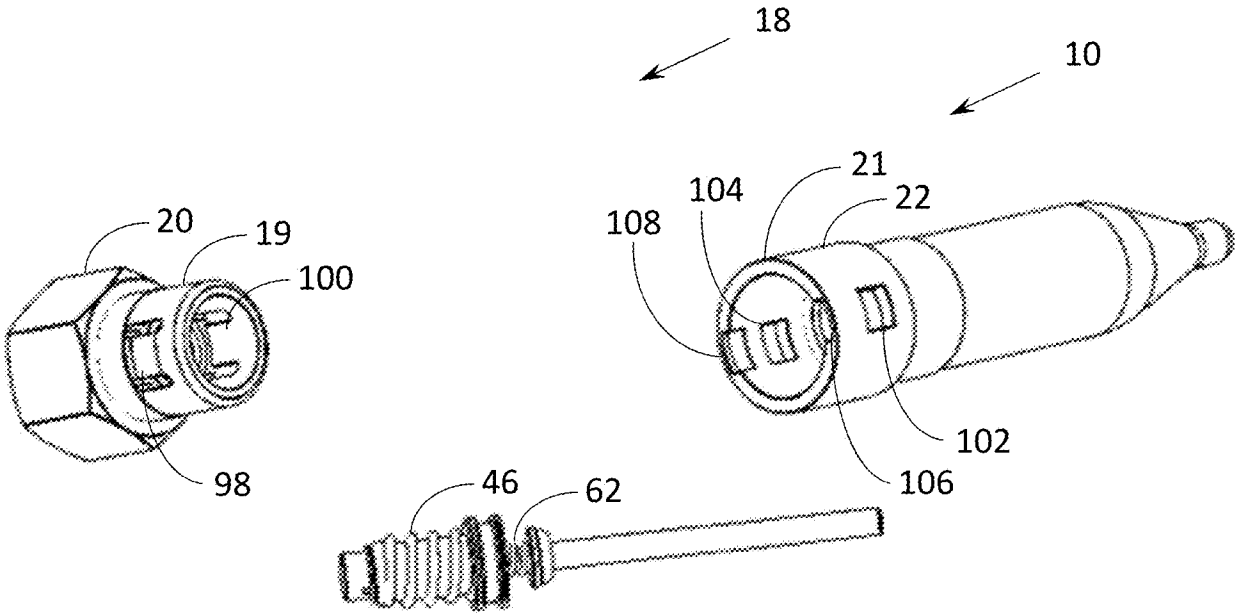
FIG. 9 is partially exploded perspective view of the high pressure reducing tilt nozzle of FIG. 2.

Referring to FIG. 9 and as illustrated, the first part 19 of the body 20 includes two diametrically opposing tabs 98, 100 and the second part 21 of the body 22 includes two corresponding slots 102, 104. To assemble the high pressure reducing tilt nozzle 10, the first and second parts of the body 18 are conveniently snapped together as shown in FIGS. 1-4 and 6-8, the tabs 98, 100 engaging the slots 102, 104 to couple the first portion 20 and the second portion 22 of the body 18 together. A corresponding set of ramps 106, 108 eases the assembly. It will be appreciated that once the high pressure reducing tilt nozzle 10 is assembled, a user could depress the diametrically opposing tabs 98, 100, separate the two portions 20, 22 of the body 18, and change one or more of the first and the second springs 46, 62 to select a different pressure limit upon reassembly.

Figure 10:
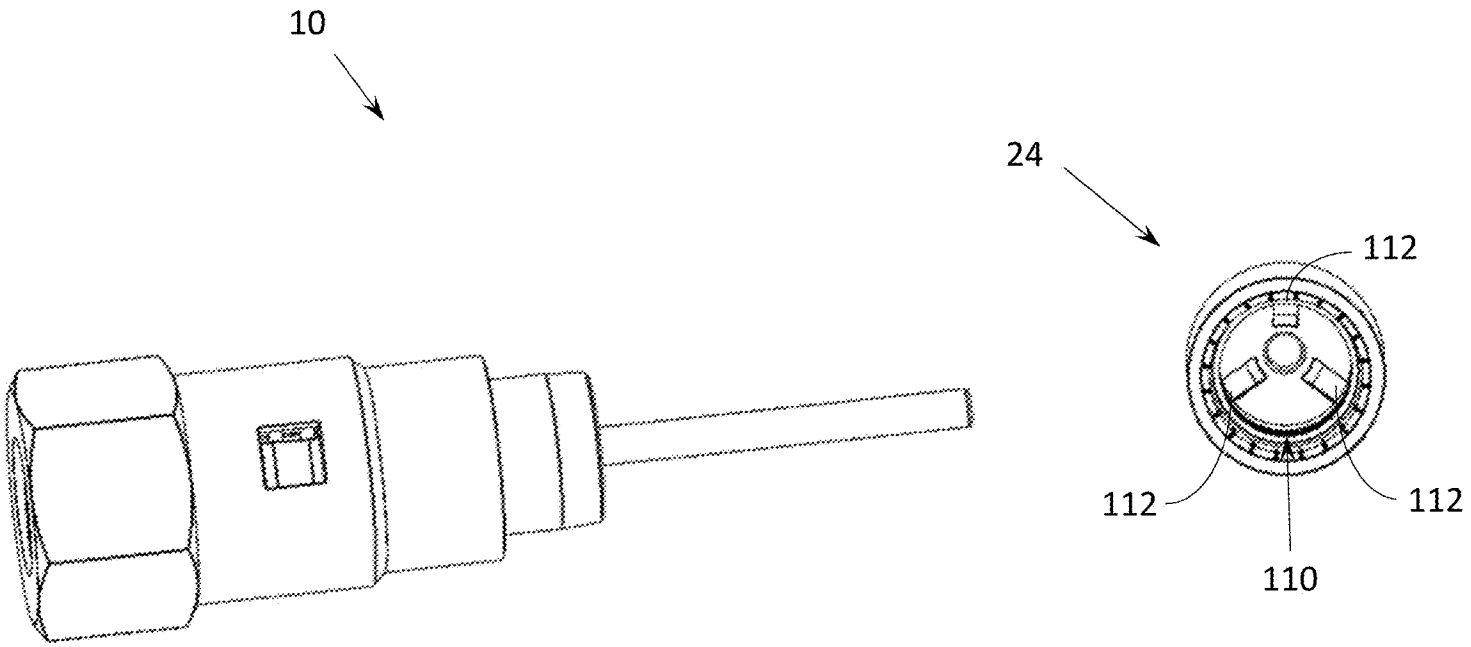
FIG. 10 is another is partially exploded perspective view of the high pressure reducing tilt nozzle of FIG. 2.

Referring to FIGS. 4, 6, and 10, the rubber sleeve 24 also has a common longitudinal axis 84. Perpendicular to the longitudinal axis 84, the rubber sleeve 24 includes a plurality of circular interior ribs 110 (FIG. 4). The plurality of circular interior ribs 110 function to prevent a user from sealing off the high pressure reducing tilt vale 10 when dispensing gas or filling balloons. The rubber sleeve 24 also includes a plurality of linear interior grooves 112 situated along the longitudinal axis 84 (FIG. 6). In the embodiment shown, the plurality of linear interior ribs 112 comprise three interior grooves oriented every 120 degrees (FIG. 10). In use, the plurality of linear interior grooves 112 also prevent a user from pinching off the rubber sleeve 24 and preventing the dispensing of gas. It will be appreciated that other arrangements of ribs and grooves can be utilized to prevent pinching off.

The aforementioned systems, components, (e.g., valves, cylinders, among others), and the like have been described with respect to interaction between several components and/or elements. It should be appreciated that such devices and elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein.

While the embodiments discussed herein have been related to the systems and methods discussed above, these embodiments are intended to be exemplary and are not intended to limit the applicability of these embodiments to only those discussions set forth herein.

The above examples are merely illustrative of several possible embodiments of various aspects of the present invention, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (e.g., that is functionally equivalent), even though not structurally equivalent to the disclosed structure which performs the function in the illustrated implementations of the invention. In addition although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

The best mode for carrying out the invention has been described for purposes of illustrating the best mode known to the applicant at the time and enable one of ordinary skill in the art to practice the invention, including making and using devices or systems and performing incorporated methods. The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A pressure reducing tilt nozzle comprising:

a body defining a cavity having an inlet and an outlet;

a piston disposed in the cavity and biased in a first piston position away from the inlet allowing flow through the inlet, the piston being movable toward the inlet to a second piston position preventing flow through the inlet when pressure in the cavity overcomes a biasing force biasing the piston in the first piston position; and a spindle having a first end disposed in the cavity and a second end, the spindle being biased in a first spindle position toward the outlet preventing flow through the outlet and being movable to a second spindle position allowing flow through the outlet thereby reducing the pressure in the cavity such that the piston moves to the first piston position, wherein the cavity angles outward at the outlet to define a flared region, and wherein the spindle is tiltable in the flared region to move the spindle to the second spindle position allowing flow through the outlet.

2. The pressure reducing tilt nozzle according to claim 1, further including a first spring biasing the piston in the first piston position and a second spring biasing the spindle in the first spindle position.

3. The pressure reducing tilt nozzle according to claim 2, wherein an inner ledge of the body and a shoulder of the piston define respective spring seats for the first spring, and an inner ledge of the piston and the spindle define respective spring seats for the second spring.

4. The pressure reducing tilt nozzle according to claim 2, wherein the biasing force of the first spring is greater than a biasing force of the second spring.

5. The pressure reducing tilt nozzle according to claim 1, further including a sleeve coupled to the body and surrounding the second end of the spindle, wherein the sleeve is configured to be moved by a user to move the spindle from the first spindle position to the second spindle position.

6. The pressure reducing tilt nozzle according to claim 1, wherein the piston divides the cavity into a first pressure chamber and a second pressure chamber, and wherein the piston includes an axial fluid passageway fluidly connecting the first and second pressure chambers.

7. The pressure reducing tilt nozzle according to claim 6, wherein the piston further includes a cross bore perpendicular to and in fluidic communication with the axial fluid passageway to allow fluid flow from the first pressure chamber to the second pressure chamber.

8. The pressure reducing tilt nozzle according to claim 6, wherein a surface area of the piston in the first pressure chamber is less than a surface area of the piston in the second pressure chamber.

9. The pressure reducing tilt nozzle according to claim 1, wherein the spindle includes a spindle rod and a disk coupled to the spindle rod at the first end of the spindle.

10. The pressure reducing tilt nozzle according to claim 9, wherein the disk includes a front side configured to abut a seal in the first spindle position to prevent flow through the outlet and a back side that serves as a spring seat.

11. A pressure reducing tilt nozzle comprising:

a body defining a cavity having an inlet and an outlet;

a piston disposed in the cavity and biased in a first piston position away from the inlet allowing flow through the inlet, the piston being movable toward the inlet to a second piston position preventing flow through the inlet when pressure in the cavity overcomes a biasing force biasing the piston in the first piston position; and a spindle having a first end disposed in the cavity and a second end, the spindle being biased in a first spindle position toward the outlet preventing flow through the outlet and being movable to a second spindle position allowing flow through the outlet thereby reducing the pressure in the cavity such that the piston moves to the first piston position, wherein the body has a first portion and a second portion, wherein the first portion includes diametrically opposing tabs and the second portion includes corresponding slots, and wherein the tabs engage with the slots to couple the first and second portions together.

12. The pressure reducing tilt nozzle according to claim 11, further including a first spring biasing the piston in the first piston position and a second spring biasing the spindle in the first spindle position.

13. The pressure reducing tilt nozzle according to claim 12, wherein an inner ledge of the body and a shoulder of the piston define respective spring seats for the first spring, and an inner ledge of the piston and the spindle define respective spring seats for the second spring.

14. The pressure reducing tilt nozzle according to claim 12, wherein the biasing force of the first spring is greater than a biasing force of the second spring.

15. A pressure reducing tilt nozzle comprising:

a piston pressure regulator including:

a body having a first portion and a second portion defining a cylinder, the first portion having an inlet configured to be in fluid communication with a source of pressurized gas and the second portion having an outlet;

a piston slideable within the cylinder and including a first end, a second end, and a fluid passageway, the first end forming with the body a first pressure chamber and the second end forming with the body a second pressure chamber, the first and second pressure chambers being in fluid communication through the fluid passageway; and a first spring disposed between the piston and the first portion of the body; and a spindle including:

a spindle rod having a proximal end and a distal end, the distal end of the spindle rod extending through the outlet and being tiltingly responsive to a lateral force on the spindle rod applied by a use; and a disk coupled to the proximal end of the spindle rod, the disk including a first side forming a spring seat and a second side configured to seal to the outlet, the disk being biased toward the outlet to seal to the outlet, wherein when a force is applied to the distal end of the spindle rod to tilt the spindle rod and the disk out of sealing contact with the outlet, a gas is dispensed through the outlet from the source of pressurized gas.

16. The pressure reducing tilt nozzle according to claim 15, wherein a surface area of the piston in the first pressure chamber is less than a surface area of the piston in the second pressure chamber.

17. The pressure reducing tilt nozzle according to claim 15, further comprising a rubber sleeve enclosing the distal end of the spindle rod and having proximal and distal ends, the proximal end being coupled to the second portion of the body and the distal end being configured to receive a neck of a balloon.

18. The pressure reducing tilt nozzle according to claim 17, wherein the rubber sleeve has a longitudinal axis and includes a plurality of circular interior ribs perpendicular to the longitudinal axis for preventing a user from sealing off the rubber sleeve when dispensing a gas.

19. The pressure reducing tilt nozzle according to claim 18, wherein the rubber sleeve includes a plurality of linear interior grooves situated along the longitudinal axis for preventing the user from pinching off the rubber sleeve and preventing the dispensing of gas.

20. The pressure reducing tilt nozzle according to claim 15, wherein the piston has a longitudinal axis, wherein the fluid passageway comprises an axial bore along a portion of the longitudinal axis and a cross bore perpendicular to the longitudinal axis, and wherein the axial bore and the cross bore are in fluid communication.

* * * * *